US008132418B2

(12) United States Patent
Hall, Jr. et al.

(10) Patent No.: US 8,132,418 B2
(45) Date of Patent: Mar. 13, 2012

(54) COOLING WITH REFRIGERANT FEEDBACK

(76) Inventors: Robert Albion Hall, Jr., Kenner, LA (US); Emmett H. Ammons, Jr., Covington, LA (US); Connelly Kendrick Hayward, Mandeville, LA (US)

( * ) Notice: Subject to any disclaimer, the term of this patent is extended or adjusted under 35 U.S.C. 154(b) by 863 days.

(21) Appl. No.: 12/198,892

(22) Filed: Aug. 27, 2008

(65) Prior Publication Data

US 2010/0050667 A1 Mar. 4, 2010

(51) Int. Cl.
*F25B 15/00* (2006.01)
*F25D 25/00* (2006.01)

(52) U.S. Cl. ..... 62/101; 62/271

(58) Field of Classification Search ..... 62/101, 62/271, 119, 238.3, 515
See application file for complete search history.

(56) References Cited

U.S. PATENT DOCUMENTS 1,506,530 A * 8/1924 Kasley ..... 62/101
1,936,166 A * 11/1933 Kendall ..... 285/125.1
1,955,697 A * 4/1934 Altenkirch ..... 62/101
1,989,520 A * 1/1935 Maiuri ..... 62/489
2,131,782 A * 10/1938 Maiuri ..... 62/110
2,150,369 A * 3/1939 Flukes ..... 62/142
2,405,553 A * 8/1946 Allison ..... 210/760
3,273,350 A * 9/1966 Taylor ..... 62/101
4,171,619 A * 10/1979 Clark ..... 62/235.1
4,178,989 A * 12/1979 Takeshita et al. ..... 165/62
4,333,515 A * 6/1982 Wilkinson et al. ..... 62/101
4,374,467 A * 2/1983 Briley ..... 62/238.1
4,448,031 A * 5/1984 Rojey et al. ..... 62/101
4,509,589 A * 4/1985 Carlson et al. ..... 165/95
4,955,930 A * 9/1990 Robinson, Jr. ..... 62/79
5,842,357 A * 12/1998 Siwajek et al. ..... 62/625
6,230,517 B1 * 5/2001 Ishiguro et al. ..... 62/476
6,866,092 B1 * 3/2005 Molivadas ..... 165/104.21
7,201,017 B2 * 4/2007 Barth et al. ..... 62/476
2005/0132724 A1 * 6/2005 Sharma et al. ..... 62/101
2006/0048536 A1 * 3/2006 Beck ..... 62/324.2
2006/0230776 A1 * 10/2006 Inoue et al. ..... 62/324.2

* cited by examiner

*Primary Examiner* — Judy Swann
*Assistant Examiner* — Alexis Cox
(74) *Attorney, Agent, or Firm* — Ash Tankha; Lipton, Weinberger & Husick

(57) ABSTRACT

Disclosed herein is a method and apparatus for cooling an environment using a low temperature heat source. A cooling apparatus is provided. A refrigerant is vaporized from a refrigeration solution using the low temperature heat source. The vaporized refrigerant with part of the refrigeration solution is channeled to a separator. The vaporized refrigerant is separated from the channeled refrigeration solution. The refrigerant is further vaporized from the separated refrigeration solution leaving behind a dilute refrigeration solution. The refrigerant is condensed. A part of the condensed refrigerant is fed to the first vaporizer leaving behind a residual part of the condensed refrigerant. The residual part of the condensed refrigerant is evaporated by absorbing heat from the environment thereby cooling the environment. The evaporated refrigerant is absorbed by the dilute refrigeration solution to produce a concentrated refrigeration solution. The concentrated refrigeration solution is fed to the first vaporizer via a heat exchanger.

15 Claims, 4 Drawing Sheets

COOLING WITH REFRIGERANT FEEDBACK

BACKGROUND

This invention, in general, relates to refrigeration. More particularly, this invention relates to cooling an environment using a low temperature heat source.

Refrigeration is used for cooling private homes and public buildings, and for preserving edible items in homes, restaurants and large storage warehouses. Refrigeration is also used in manufacturing industries, oil refineries, chemical plants, and petrochemical plants. Healthcare institutions, for example, hospitals, pharmacies, and blood banks, use refrigeration to store medicines, samples, etc. Refrigeration is also used for transport of temperature sensitive goods by trucks, trains, airplanes, and sea vessels.

Typically, cooling apparatuses require a large amount of energy for cooling an environment. Compressor type cooling apparatuses typically require electricity for operation. Absorber type cooling apparatuses may run on sources of energy other than electricity, for example, a heat source. However, the absorption type cooling apparatuses require high temperature heat sources, for example, gas burners, electric heating elements, etc., for operation. A heat source providing temperatures sufficient to operate an absorber type cooling apparatus may be difficult to obtain from the environment or waste heat. If the heat is supplied using gas burners or electric heat sources, the cooling apparatus may be as expensive as compressor type cooling apparatuses. Furthermore, the initiation time and termination time in absorption type cooling apparatuses are high, thereby reducing the initial cooling efficiency and the total cooling efficiency of the cooling apparatus. Furthermore, current absorber type cooling apparatuses are less user friendly, and therefore a less practical apparatus.

Hence, there is a need for a method of cooling an environment using a low temperature heat source where the initiation time and termination time are sufficiently low.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The method and apparatus disclosed herein address the above stated need for cooling an environment using a low temperature heat source. The low temperature heat source may, for example, be at a temperature of about 20 degrees Fahrenheit above ambient temperature. The cooling apparatus comprises a first vaporizer, a second vaporizer, a separator, a condenser, a feedback circuit, an evaporator, an absorber, and a heat exchanger. A refrigerant is vaporized from a refrigeration solution in the first vaporizer using the low temperature heat source. The refrigeration solution comprises the refrigerant and an absorbent. The vaporized refrigerant with part of the refrigeration solution is channeled to the separator. The vaporized refrigerant with part of the refrigeration solution may be channeled to the separator through multiple lift columns. The vaporized refrigerant is separated from the channeled refrigeration solution in the separator. The vaporized refrigerant is thereafter channeled to the condenser.

The refrigerant is further vaporized from the separated refrigeration solution in the second vaporizer. The vaporized refrigerant is channeled to the condenser leaving behind a dilute refrigeration solution in the second vaporizer. The dilute refrigeration solution is fed to the absorber via the heat exchanger. The channeled refrigerant from the separator and the second vaporizer is condensed in the condenser. A part of the condensed refrigerant is fed to the first vaporizer via the feedback circuit leaving behind a residual part of the condensed refrigerant. The feeding of the condensed refrigerant to the first vaporizer increases the concentration of the refrigerant in the refrigeration mixture in the first absorber, thereby lowering the boiling point of the refrigeration solution. The residual part of the condensed refrigerant is evaporated in the evaporator by absorbing heat from the environment. The evaporator contains an inert gas for maintaining isobaric pressure in the evaporator.

The evaporated refrigerant is fed into the absorber. The evaporated refrigerant is absorbed by the dilute refrigeration solution to produce a concentrated refrigeration solution in the absorber. The evaporated refrigerant may be absorbed by the dilute refrigeration solution in multiple absorber columns. The concentrated refrigeration solution is fed to the first vaporizer via the heat exchanger. The concentrated refrigeration solution absorbs heat from the dilute refrigeration solution in the heat exchanger and is thereby preheated. Further, by releasing heat in the heat exchanger, the dilute refrigeration solution attains optimum temperature for absorbing the evaporated refrigerant in the absorber.

The cooling apparatus may initiate the cooling prior to the vaporization of the refrigerant in the first vaporizer. An evaporator fan is provided at the evaporator. A condenser fan is provided at the condenser. A condenser valve, multiple separator input valves, an absorber valve, and an evaporator valve are provided. The condenser valve, the separator input valves, the absorber valve, and the evaporator valve are in proximity to the condenser, the separator, the absorber, the evaporator respectively.

The evaporator fan and the condenser fan are activated for cooling the evaporator and the condenser respectively. The low temperature heat source for heating the first vaporizer is activated. When the first vaporizer attains a predefined temperature, the condenser valve is opened for allowing the vaporized refrigerant to be channeled into the condenser. The separator input valves are opened for allowing the vaporized refrigerant with part of the refrigeration solution to be channeled to the separator. When a pressure difference is created between the separator and the absorber, the absorber valve is opened for allowing the dilute refrigeration solution to be fed into the absorber. When a pressure difference is created between the condenser and the evaporator, the evaporator valve is opened for allowing the condensed refrigerant to flow into the evaporator. Initiation of the flow of the vaporized refrigerant, the condensed refrigerant, and the dilute refrigeration solution in the cooling apparatus initiates the cooling. The initiation of the cooling is accelerated by the feeding of the condensed refrigerant to the first vaporizer via the feedback circuit. The feeding of the condensed refrigerant to the first vaporizer is enabled by the microcontroller when the first vaporizer attains the predefined temperature.

The cooling apparatus may further terminate the cooling. The low temperature heat source is deactivated to stop heating the first vaporizer. The evaporator valve is closed for stopping the flow of the condensed refrigerant into the evaporator. The absorber valve is closed for stopping the feeding of the dilute refrigeration solution into the absorber. The separator input valves are closed for stopping the channeling of the vaporized refrigerant with part of the refrigeration solution to the separator. The condenser valve is closed for stopping the channeling of the vaporized refrigerant into the condenser. The evaporator fan and the condenser fan are deactivated for stopping the cooling of the evaporator and the condenser respectively.

Flow of the refrigerant, the dilute refrigeration solution, and the concentrated refrigeration solution is controlled using a microcontroller. The absorption of heat from the environment performs the cooling while the lowering of the boiling point and the preheating of the concentrated refrigeration solution enable the low temperature heat source to be used for the cooling.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
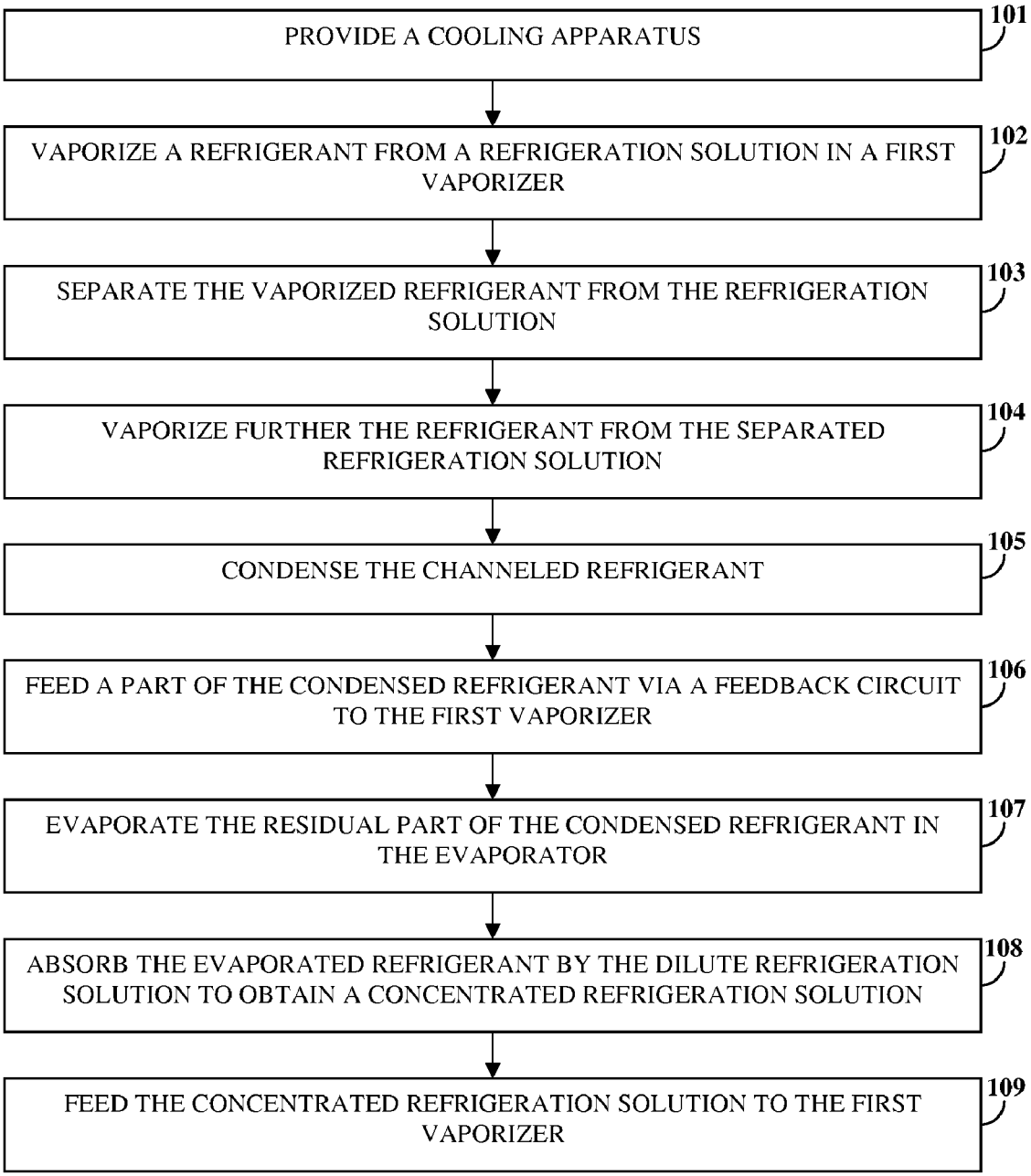
FIG. 1 illustrates a method of cooling an environment using a low temperature heat source.
Figure 2:
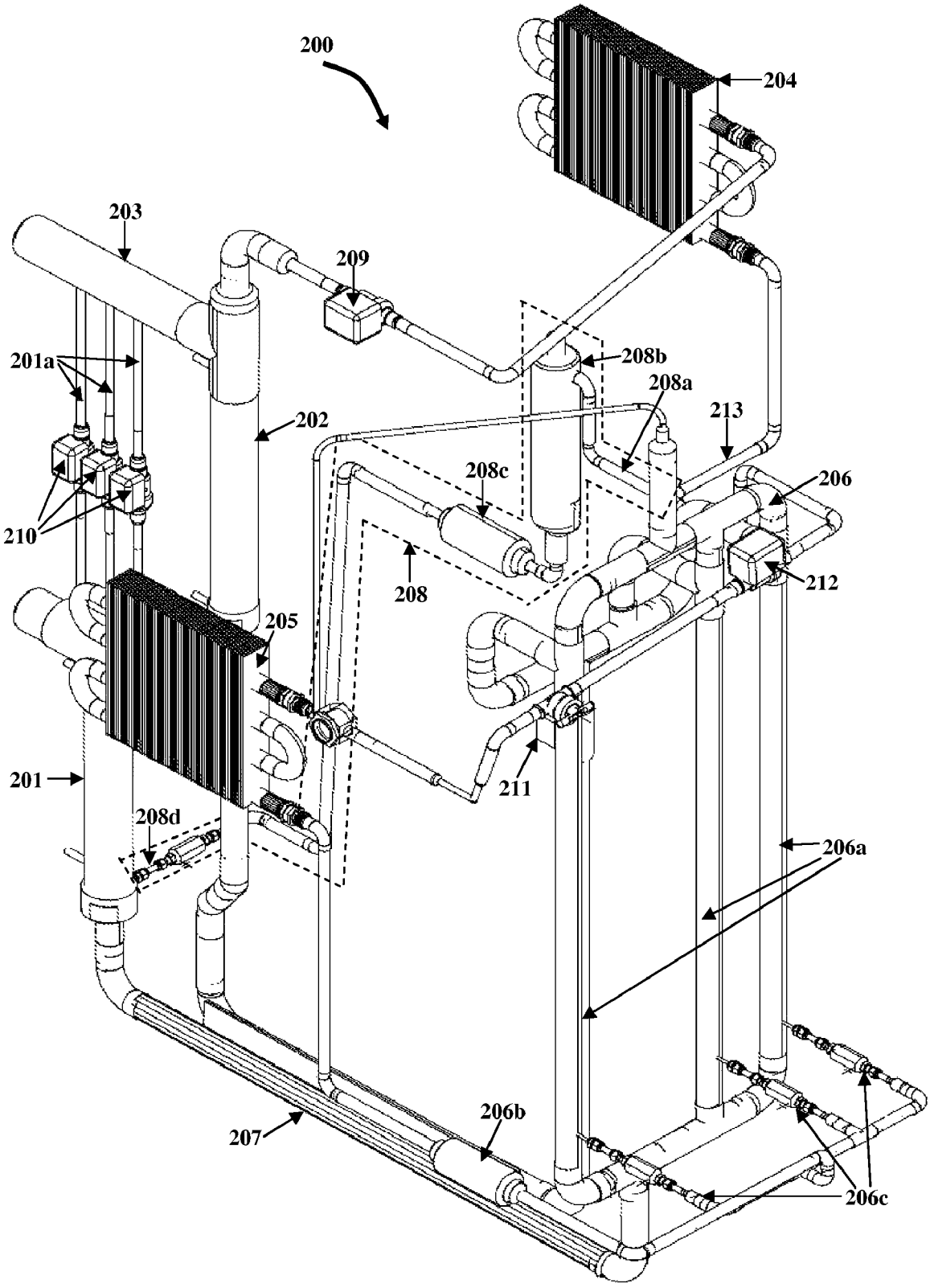
FIG. 2 illustrates an isometric view of a cooling apparatus for cooling an environment using a low temperature heat source.

FIG. 1 illustrates a method of cooling an environment using a low temperature heat source, for example, a solar water heater, excess heat from home systems, waste heat from industrial systems, etc. A cooling apparatus 200 is provided 101 as illustrated in FIG. 2. The cooling apparatus 200 comprises a first vaporizer 201, a second vaporizer 202, a separator 203, a condenser 204, a feedback circuit 208, an evaporator 205, an absorber 206, and a heat exchanger 207. The cooling apparatus 200 may operate in a run mode, a startup mode, and a shut down mode. In the run mode, a refrigerant is vaporized 102 from a refrigeration solution in the first vaporizer 201 using the low temperature heat source (not shown). The heat may be transferred to the first vaporizer 201 via a heating fluid pump, for example, a hot water pump, a heated anti freeze pump, a hot oil pump, etc. The low temperature heat source may, for example, be at a temperature of about 20 degrees Fahrenheit above ambient temperature. The refrigeration solution comprises the refrigerant and an absorbent. The refrigerant may, for example, be composed of chlorofluorocarbons, hydrochlorofluorocarbons, hydrofluorocarbons, etc. The absorbent may be oil or a lubricant miscible with the refrigerant. The absorbent used may vary based on the refrigerant used.

The vaporized refrigerant with part of the refrigeration solution is channeled to the separator 203. The vaporized refrigerant may be channeled with part of the refrigeration solution to the separator 203 through multiple lift columns 201*a*. The vaporized refrigerant and part of the refrigeration solution are channeled together through the lift columns 201*a*, and there is no separate column for the vaporized refrigerant. The vaporized refrigerant is separated 103 from the channeled refrigeration solution in the separator 203. The vaporized refrigerant is channeled to the condenser 204, while the separated refrigeration solution is fed to the second vaporizer 202.

The refrigerant is further vaporized 104 from the separated refrigeration solution in the second vaporizer 202. The vaporized refrigerant is channeled to the condenser 204 with the vaporized refrigerant from the separator 203, leaving behind a dilute refrigeration solution in the second vaporizer 202. The dilute refrigeration solution is fed to the absorber 206 via the heat exchanger 207. The channeled refrigerant from the separator 203 and the second vaporizer 202 is condensed 105 in the condenser 204. A part of the condensed refrigerant is fed 106 via the feedback circuit 208 to the first vaporizer 201 leaving behind a residual part of the condensed refrigeration solution. The feeding of the condensed refrigerant to the first vaporizer 201 increases the concentration of the refrigerant in the refrigeration mixture in the first vaporizer 201. Since the boiling point of the refrigerant is lower than the boiling point of the absorbent, the increase in the concentration lowers the boiling point of the refrigeration solution. The lowering of the boiling point enables the low temperature heat source to be used to vaporize the refrigerant in the first vaporizer 201. Hence, the feedback circuit 208 enables low temperature operation of the cooling apparatus 200. The feedback circuit 208 is explained in the detailed description of FIG. 2.

The residual part of the condensed refrigerant is introduced into the evaporator 205. The evaporator 205 contains an inert gas, for example, helium, for maintaining an isobaric total pressure in the evaporator 205. According to Dalton's law of partial pressures, total pressure exerted by a mixture of gaseous components is equal to sum of partial pressures of each of the gaseous components in the mixture. Since a part of the isobaric total pressure is exerted by the inert gas, the partial pressure of the condensed refrigerant is reduced. The boiling point of the condensed refrigerant reduces with the partial pressure, and the condensed refrigerant is evaporated 107 in the evaporator 205. The condensed refrigerant absorbs heat from the environment for evaporation, thereby cooling the environment. The evaporation of the condensed refrigerant in the evaporator 205 causes the cooling of the environment. The temperature of the environment may be controlled by controlling the partial pressure of the condensed refrigerant in the evaporator 205.

The evaporated refrigerant is fed into the absorber 206 with part of the inert gas from the evaporator 205. The dilute refrigeration solution fed to the absorber 206 via the heat exchanger 207 absorbs 108 the evaporated refrigerant to produce a concentrated refrigeration solution in the absorber 206. The evaporated refrigerant may be absorbed by the dilute refrigeration solution in multiple absorber columns 206*a*. The evaporated refrigerant with part of the inert gas is bubbled through the dilute refrigeration solution in the absorber 206. The inert gas is not absorbed by the dilute refrigeration solution in the absorber 206, thereby isolating the inert gas in a gaseous state. The inert gas is channeled back into the evaporator 205 from the absorber 206. The concentrated refrigeration solution is fed 109 to the first vaporizer 201 via the heat exchanger 207. The concentrated refrigeration solution absorbs heat from the dilute refrigeration solution in the heat exchanger 207. The dilute refrigeration solution from the second vaporizer 202 has a heat content higher than optimum for absorbing the evaporated refrigerant. By absorbing heat from the dilute refrigeration solution in the heat exchanger 207, the concentrated refrigeration solution is preheated before being fed into the first vaporizer 201. Since the concentrated refrigeration solution is preheated, the low temperature heat source is sufficient to vaporize the refrigerant. Further, by releasing heat in the heat exchanger 207, the dilute refrigeration solution attains an optimum temperature for absorbing the evaporated refrigerant in the absorber 206.

The cooling apparatus 200 may initiate the cooling prior to the vaporization of the refrigerant in the first vaporizer 201 in the startup mode. An evaporator fan (not shown) is provided at the evaporator 205 and a condenser fan (not shown) is provided at the condenser 204. Multiple separator input valves 210, an absorber valve 211, and an evaporator valve 212 are provided. The condenser valve 209, the multiple separator input valves 210, the absorber valve 211, and the evaporator valve 212 are in proximity to the condenser 204, the separator 203, the absorber 206, and the evaporator 205 respectively. The evaporator fan and the condenser fan are activated for cooling the evaporator 205 and the condenser 204 respectively.

The low temperature heat source is activated for heating the first vaporizer 201. When the first vaporizer 201 attains a predefined temperature, the condenser valve 209 is opened for allowing the vaporized refrigerant to be channeled into the condenser 204. The separator input valves 210 are opened for allowing the vaporized refrigerant with a part of the refrigeration solution to be channeled into the separator 203. When a pressure difference is created between the separator 203 and the absorber 206, the absorber valve 211 is opened for allowing the dilute refrigeration solution to be fed into the absorber 206. When a pressure difference is created between the condenser 204 and the evaporator 205, the evaporator valve 212 is opened for allowing the condensed refrigerant to flow into the evaporator 205. Initiation of the flow of the vaporized refrigerant, the condensed refrigerant, and the dilute refrigeration solution in the cooling apparatus 200 initiates the cooling. The initiation of the cooling is accelerated by the feeding of the condensed refrigerant to the first vaporizer 201 via the feedback circuit 208. The feeding of the condensed refrigerant to the first vaporizer 201 is enabled by the microcontroller when the first vaporizer 201 attains the predefined temperature.

The cooling apparatus 200 may further terminate the cooling in the shut down mode. The low temperature heat source is deactivated to stop heating the first vaporizer 201. The evaporator valve 212 is then closed for stopping the flow of the condensed refrigerant into the evaporator 205. The absorber valve 211 is then closed for stopping the feeding of the dilute refrigeration solution into the absorber 206. The separator input valves 210 are then closed for stopping the channeling of the vaporized refrigerant with part of the refrigeration solution to the separator 203. The condenser valve 209 is then closed for stopping the channeling of the vaporized refrigerant into the condenser 204. Finally, the evaporator fan and the condenser fan are deactivated for stopping the cooling of the evaporator 205 and the condenser 204 respectively. The evaporator fan and the condenser fan are deactivated last to allow cooling of the evaporator 205 and the condenser 204 till the cooling is completely terminated.

The flow of the refrigerant, the dilute refrigeration solution, and the concentrated refrigeration solution is controlled using a microcontroller. The absorption of heat from the environment performs the cooling while the lowering of the boiling point and the preheating of the concentrated refrigeration solution enable the low temperature heat source to be used for the cooling.

FIG. 2 illustrates an isometric view of a cooling apparatus 200 for cooling an environment using a low temperature heat source. The cooling apparatus 200 comprises a first vaporizer 201, a second vaporizer 202, a separator 203, a condenser 204, an evaporator 205, an absorber 206, a heat exchanger 207, and a feedback circuit 208. The cooling apparatus 200 may further comprise a control module. The control module comprises a microcontroller and multiple solid state relays. The control module enables quick starting up of the cooling apparatus 200 and initiates the cooling. The control module also enables quick shutting down of the cooling apparatus 200 and terminates the cooling. The control module may further comprise multiple sensors. The sensors may be, for example, temperature sensors, pressure sensors, and liquid level differential sensors in different parts of the cooling apparatus 200. The sensors may be placed inside different components of the cooling apparatus 200.

Figure 3:
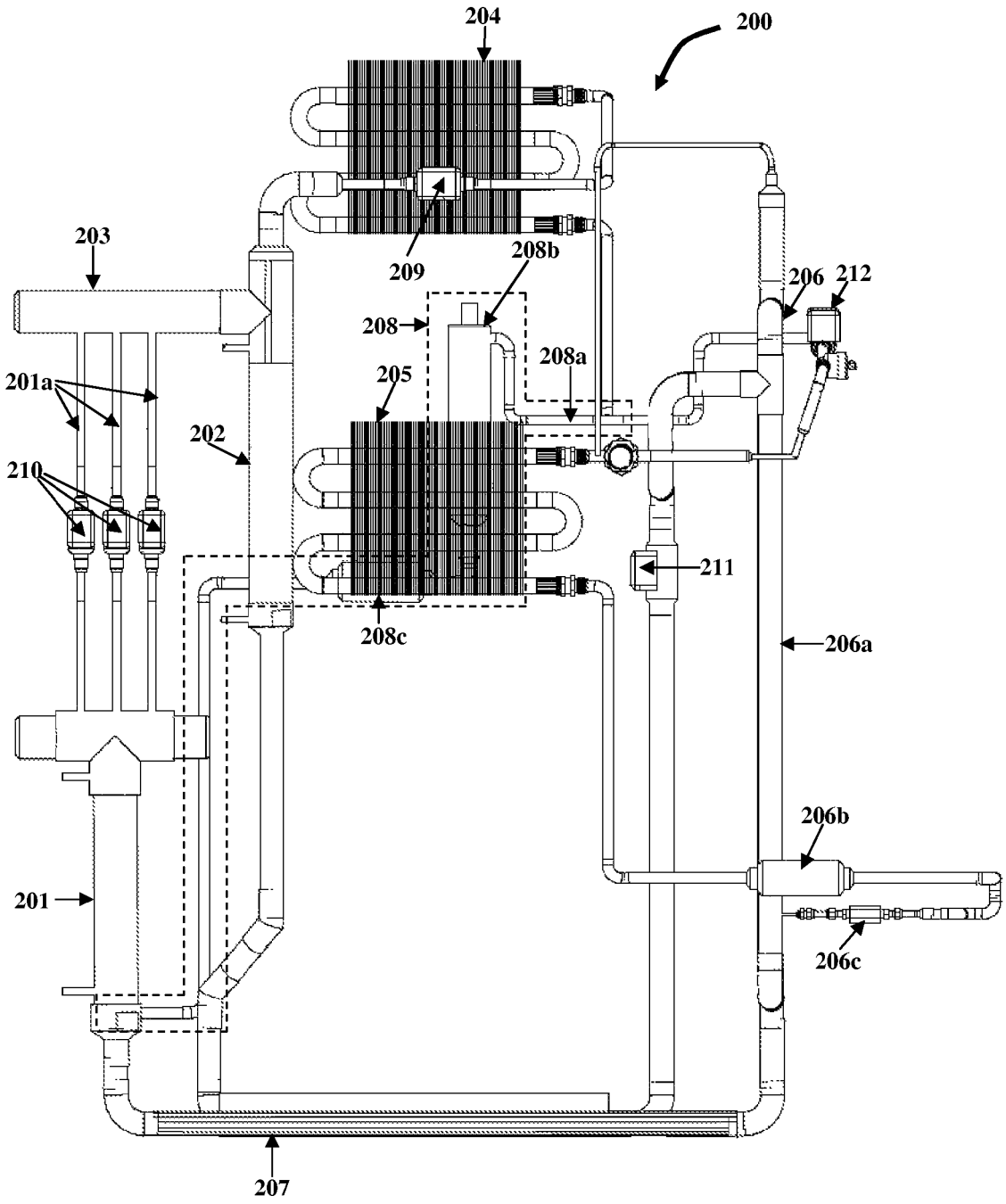
FIG. 3 exemplarily illustrates a front view of a cooling apparatus for cooling an environment using a low temperature heat source.
Figure 4:
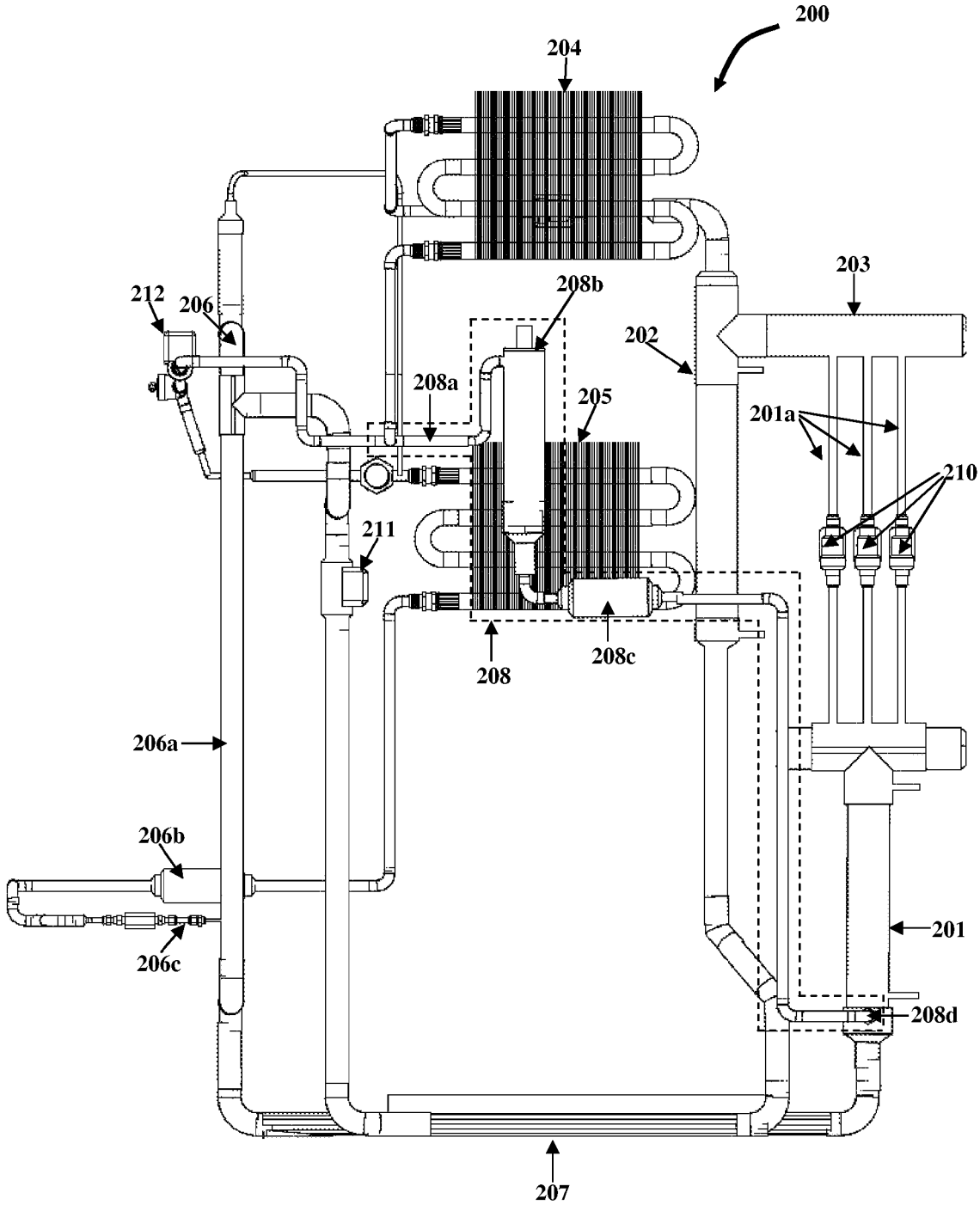
FIG. 4 exemplarily illustrates a back view of a cooling apparatus for cooling an environment using a low temperature heat source.

The cooling apparatus 200 may operate in a run mode, a startup mode, and a shut down mode. The microcontroller monitors the sensors in the run mode, the startup mode, and the shut down mode. A front view of the cooling apparatus 200 for cooling an environment using a low temperature heat source is exemplarily illustrated in FIG. 3. A back view of the cooling apparatus 200 for cooling an environment using a low temperature heat source is exemplarily illustrated in FIG. 4. The first vaporizer 201 vaporizes a refrigerant from a refrigeration solution. The refrigeration solution comprises the refrigerant and an absorbent. The first vaporizer 201 is heated using a low temperature heat source for vaporizing the refrigerant. Multiple lift columns 201*a* channel the vaporized refrigerant with part of the refrigeration solution to the separator 203.

The separator 203 separates the vaporized refrigerant from the channeled refrigeration solution. Due to gravity, the refrigeration solution in the separator 203 enters the second vaporizer 202, while the vaporized refrigerant is channeled into the condenser 204. The second vaporizer 202 further vaporizes the refrigerant from the separated refrigeration solution. The vaporized refrigerant is channeled into the condenser 204 with the vaporized refrigerant from the separator 203. A dilute refrigeration solution is left behind in the second vaporizer 202. The heat exchanger 207 feeds the diluted refrigeration solution to the absorber 206.

The condenser 204 condenses the channeled refrigerant from the separator 203 and the second vaporizer 202. Due to gravity, the condensed refrigerant flows into a manifold 213. The manifold 213 has two outlets. The manifold 213 feeds a part of the condensed refrigerant to the feedback circuit 208, leaving behind a residual part of the condensed refrigeration solution. The feedback circuit 208 comprises a liquid trap 208*a*, a refrigerant reservoir 208*b*, a feedback pump 208*c*, and an injector 208*d*. The liquid trap 208*a* comprises a liquid level switch (not shown) for preventing evaporated refrigerant and inert gas from the evaporator 205 from entering the condenser 204. The liquid level switch disables the feedback circuit 208 if liquid level in the liquid trap 208*a* is too low to prevent the evaporated refrigerant and the inert gas from the evaporator 205 from entering the condenser 204. The liquid level switch comprises a floating contact and a stationary contact. The floating contact and the stationary contact form a pair of electrical contacts which opens the liquid level switch when not in contact with each other, and closes the liquid level switch when in contact with each other. The floating contact floats on the liquid, and the stationary contact may be fixed at a position above the floating contact. When the liquid level in the liquid level switch rises, the floating contact rises and makes contact with the stationary contact. When the floating contact makes contact with the stationary contact, the liquid level switch is closed and sends a signal to the microcontroller for executing a preprogrammed function, for example, enabling or disabling the feedback pump 208*c*.

The refrigerant reservoir 208*b* stores the condensed refrigerant. The feedback pump 208*c* pumps the stored refrigerant from the refrigerant reservoir 208*b* to the first vaporizer 201. The injector 208*d* injects the pumped condensed refrigerant to the first vaporizer 201. When the feedback circuit 208 is enabled, the feedback pump 208*c* pumps a fixed amount of the stored refrigerant in short pulses at predefined intervals of time into the first vaporizer 201 through the injector 208*d*. A microcontroller may control the feedback pump 208*c*.

The feedback circuit 208 may reduce the overall thermal efficiency of the cooling apparatus 200. However, the feedback circuit 208 reduces operating temperature in the first vaporizer 201, thereby reducing the temperature required by the cooling apparatus 200 for operation. The reduced temperature required by the cooling apparatus 200 enables the cooling apparatus 200 to be used using commonly available low temperature heat sources, for example, solar water heaters, excess heat from home systems, waste heat from industrial systems, etc.

The evaporator 205 contains an inert gas, for example, helium, for maintaining isobaric pressure in the evaporator 205. The evaporator 205 evaporates the condensed refrigerant. The condensed refrigerant evaporates in the evaporator 205 by absorbing heat from the environment, thereby cooling the environment.

The absorber 206 comprises multiple absorber columns 206*a*, an absorber pump 206*b*, and multiple absorber injectors 206*c*. The absorber 206 may further comprise multiple liquid level switches (not shown) for sending a signal to the microcontroller. For example, the liquid level switches may send a high liquid level signal or a low liquid level signal to the microcontroller. The microcontroller may enable or disable the absorber 206 based on the signal sent by the liquid level switch. For example, the microcontroller enables the absorber 206 on receiving the high liquid level signal and disables the absorber 206 on receiving the low liquid level signal. The absorber pump 206*b* pumps the evaporated refrigerant with part of the inert gas into the absorber columns 206*a* to the absorber injectors 206*c*. The absorber pump 206*b* is a low energy pump to provide just enough pressure to overcome viscosity of the dilute refrigeration solution. The absorber injectors 206*c* inject the pumped refrigerant with part of the inert gas into the absorber columns 206*a* from the bottom of the absorber columns 206*a*. The dilute refrigeration solution fed to the absorber 206 via the heat exchanger 207 absorbs the evaporated refrigerant to produce a concentrated refrigeration solution. The dilute refrigeration solution may be fed to the absorber 206 from the top of the absorber columns 206*a*. The evaporated refrigerant with part of the inert gas bubbles through the dilute refrigeration solution. The dilute refrigeration solution does not absorb the inert gas, thereby isolating the inert gas in a gaseous state. The inert gas is channeled back into the evaporator 205. The absorber 206 may further comprise a sensor for sensing level of the dilute refrigeration solution in the absorber 206.

The heat exchanger 207 feeds the concentrated refrigeration solution to the first vaporizer 201. The heat exchanger 207 enables the concentrated refrigeration solution to absorb heat from the dilute refrigeration solution. By absorbing heat from the dilute refrigeration solution, the concentrated refrigeration solution is preheated before it is fed into the first vaporizer 201, thereby requiring a low temperature heat source for vaporizing the refrigerant in the first vaporizer 201.

The cooling apparatus 200 may further comprise an evaporator fan (not shown) at the evaporator 205 and a condenser fan (not shown) at the condenser 204 for cooling the evaporator 205 and the condenser 204 respectively. The cooling apparatus 200 may further comprise a condenser valve 209, multiple separator input valves 210, an absorber valve 211, and an evaporator valve 212. The condenser valve 209, the separator input valves 210, the absorber valve 211, and the evaporator valve 212 are in proximity to the condenser 204, the separator 203, the absorber 206, and the evaporator 205 respectively. The condenser valve 209, the separator input valves 210, the absorber valve 211, and the evaporator valve 212 may be solenoid valves. The condenser valve 209 may allow or disallow flow of the vaporized refrigerant into the condenser 204. The separator input valves 210 may allow or disallow flow of the vaporized refrigerant into the separator 203. The absorber valve 211 may allow or disallow flow of the dilute refrigeration solution into the absorber 206. The evaporator valve 212 may allow or disallow flow of the condensed refrigerant into the evaporator 205.

The control module initiates cooling prior to the vaporization of the refrigerant in the first vaporizer 201 in the startup mode. The control module activates the evaporator fan and the condenser fan for cooling the evaporator 205 and the condenser 204 respectively. The control module activates the low temperature heat source for heating the first vaporizer 201. When the first vaporizer 201 attains a predefined temperature, the control module opens the condenser valve 209 to allow the vaporized refrigerant to be channeled into the condenser 204. A sensor may sense when the predefined temperature set point is reached in the first vaporizer 201. The control module opens the separator input valves 210 for allowing the vaporized refrigerant with part of the refrigeration solution to be channeled to the separator 203.

When a pressure difference is created between the separator 203 and the absorber 206, the control module opens the absorber valve 211 for allowing the dilute refrigeration solution to be fed into the absorber 206. A sensor may sense the creation of the pressure difference between the separator 203 and the absorber 206. When a pressure difference is created between the condenser 204 and the evaporator 205, the control module opens the evaporator valve 212 to allow flow of the condensed refrigerant to the evaporator 205. A sensor may sense the creation of the pressure difference between the condenser 204 and the evaporator 205. Initiation of the flow of the vaporized refrigerant, the condensed refrigerant, and the dilute refrigeration solution in the cooling apparatus 200 initiates the cooling.

The control module further terminates the cooling in the shut down mode. The control module deactivates the low temperature heat source to stop heating the first vaporizer 201. The control module then closes the evaporator valve 212 for stopping the flow of the condensed refrigerant into the evaporator 205. The control module then closes the absorber valve 211 for stopping the feeding of the dilute refrigeration solution into the absorber 206. The control module then closes the separator input valves 210 for stopping the channeling of the vaporized refrigerant with part of the refrigeration solution to the separator 203. The control module then closes the condenser valve 209 for stopping the channeling of the vaporized refrigerant into the condenser 204. The control module then deactivates the evaporator fan and the condenser fan for stopping the cooling of the evaporator 205 and the condenser 204 respectively. The control module deactivates the evaporator fan and the condenser fan last to allow cooling of the evaporator 205 and the condenser 204 till the cooling is completely terminated.

The foregoing examples have been provided merely for the purpose of explanation and are in no way to be construed as limiting of the present invention. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

As referred to herein, a "microcontroller" may mean any one of many microprocessors that are suited to turning on and off processes or devices disclosed herein. The microcontroller comprises enough programmable input and output lines to receive logic signals from sensors and to turn on or off the appropriate devices. Support components for the microcontroller, for example, operational amplifiers, analog to digital converters etc, may be included within the microcontroller integrated circuit, or may be obtained premounted on a printed circuit board. Multiple input and output ports may be provided on the microcontroller for enabling future expansion or modification of the cooling apparatus.

We claim:

1. A method of cooling an environment using a low temperature heat source, comprising the steps of:

providing a cooling apparatus, wherein said cooling apparatus comprises a first vaporizer, a second vaporizer, a separator, a condenser, a return line, a feedback line separate from said return line and disposed between the condenser and the first vaporizer, an evaporator, an absorber, and a heat exchanger;

vaporizing a refrigerant from a refrigeration solution in said first vaporizer using said low temperature heat source, wherein said low temperature heat source is at a temperature of about 20° F. above ambient temperature, and wherein said vaporized refrigerant and part of said refrigeration solution are channeled together through a plurality of lift columns to said separator;

separating said vaporized refrigerant from said channeled refrigeration solution in the separator, wherein the vaporized refrigerant is channeled to said condenser;

vaporizing further said refrigerant from said separated refrigeration solution in said second vaporizer, wherein said vaporized refrigerant is channeled to the condenser leaving behind a dilute refrigeration solution in the second vaporizer, wherein said dilute refrigeration solution is fed to said absorber via said heat exchanger;

condensing said channeled refrigerant from the separator and the second vaporizer in the condenser;

feeding a part of said condensed refrigerant via said feedback circuit to the first vaporizer using a microcontroller controlled feedback pump, leaving behind a residual part of the condensed refrigerant in a liquid trap of the feedback circuit, wherein the feedback pump pumps the condensed refrigerant from a refrigerant reservoir in short pulses at predefined intervals of time into the first vaporizer, wherein the feedback of the condensed refrigerant lowers boiling point of the refrigeration solution in the first vaporizer, and wherein the residual part of the condensed refrigerant in the liquid trap flows by gravity, to said evaporator;

evaporating said residual part of the condensed refrigerant in said evaporator for absorbing heat from said environment, wherein said evaporated refrigerant is fed into the absorber;

absorbing said evaporated refrigerant by the dilute refrigeration solution to produce a concentrated refrigeration solution in multiple absorber columns of the absorber; and feeding said concentrated refrigeration solution to the first vaporizer via the heat exchanger, wherein the dilute refrigeration solution releases heat to the concentrated refrigeration solution in the heat exchanger to attain an optimum temperature for absorbing the evaporated refrigerant, wherein the concentrated refrigeration solution absorbs heat from the dilute refrigeration solution in the heat exchanger for preheating the concentrated refrigeration solution fed to the first vaporizer;

whereby said absorption of said heat from the environment performs said cooling while said lowering of said boiling point and said preheating of the concentrated refrigeration solution reduce an operating temperature required in the first vaporizer and enable the low temperature heat source to be used for the cooling.

2. The method of claim 1, wherein the refrigeration solution comprises a refrigerant/absorbent pair comprising the refrigerant and an absorbent, wherein said refrigerant/absorbent pair is selected appropriate for absorption refrigeration systems, and wherein the refrigerant/absorbent pair comprises one of many pairs common to compressor systems, wherein the refrigerant comprises one of chlorofluorocarbons, hydrochlorofluorocarbons, hydrofluorocarbons, and a combination thereof, and wherein said absorbent comprises one of an oil, a synthetic lubricant, and any liquid miscible with the refrigerant in a liquid phase, and wherein the absorbent is varied based on the refrigerant used.

3. The method of claim 1, wherein the evaporator contains an inert gas for maintaining isobaric pressure in the evaporator.

4. The method of claim 1, wherein the evaporated refrigerant is absorbed by the dilute refrigeration solution in a plurality of absorber columns in the absorber.

5. The method of claim 1, further comprising a step of initiating the cooling, comprising:

providing an evaporator fan at the evaporator and a condenser fan at the condenser;

providing a condenser valve in proximity to the condenser, a plurality of separator input valves in proximity to the separator, an absorber valve in proximity to the absorber, and an evaporator valve in proximity to the evaporator;

activating said evaporator fan for cooling air flowing by the evaporator, and activating said condenser fan for cooling the condenser;

activating the low temperature heat source for heating the first vaporizer;

opening said condenser valve when the first vaporizer attains a predefined temperature by a microcontroller for allowing the vaporized refrigerant to be channeled into the condenser;

opening said separator input valves by said microcontroller for allowing the vaporized refrigerant with part of the refrigeration solution to be channeled to the separator, wherein each of said separator input valves control flow of the vaporized refrigerant with part of the refrigeration solution through one of said plurality of lift columns to the separator, wherein each one of said plurality of lift columns is enabled by opening a respective separator input valve;

opening said absorber valve by said microcontroller when a pressure difference is created between the separator and the absorber for allowing the dilute refrigeration solution to be fed into the absorber; and opening said evaporator valve by said microcontroller when a pressure difference is created between the condenser and the evaporator for allowing the condensed refrigerant to flow into the evaporator;

whereby initiation of controlled flow of the vaporized refrigerant, the condensed refrigerant, and the dilute refrigeration solution by said microcontroller in the cooling apparatus initiates the cooling.

6. The method of claim 5, further comprising a step terminating the cooling, comprising the steps of:

deactivating the low temperature heat source to stop heating the first vaporizer;

closing the evaporator valve for stopping said flow of the condensed refrigerant into the evaporator;

closing the absorber valve for stopping said feeding of the dilute refrigeration solution into the absorber;

closing the separator input valves for stopping said channeling of the vaporized refrigerant with said part of the refrigeration solution into the separator;

closing a condenser valve for stopping said channeling of the vaporized refrigerant into the condenser; and deactivating the evaporator fan that cools the air flowing by the evaporator, and deactivating the condenser fan that cools the condenser;

whereby the cooling is terminated.

7. A cooling apparatus for cooling an environment using a low temperature heat source, comprising:

a first vaporizer for vaporizing a refrigerant from a refrigeration solution using said low temperature heat source, wherein said low temperature heat source is at a temperature of about 20° F. above ambient temperature, wherein said vaporized refrigerant with part of said refrigeration solution are channeled together through a plurality of lift columns to a separator;

said separator for separating said vaporized refrigerant from said channeled refrigeration solution, wherein said vaporized refrigerant is channeled to a condenser;

a second vaporizer for vaporizing further said refrigerant from said separated refrigeration solution, wherein said vaporized refrigerant is channeled to said condenser leaving behind a dilute refrigeration solution in said second vaporizer, wherein said dilute refrigeration solution is fed to an absorber via a heat exchanger;

a condenser for condensing said channeled refrigerant from the separator and the second vaporizer; a return line; a feedback line separate from the return line and disposed between the condenser and the first vaporizer for feeding a part of said condensed refrigerant to said first vaporizer using a microcontroller controlled feedback pump leaving behind a residual part of the condensed refrigerant in a liquid trap of the feedback circuit, wherein the feedback pump pumps the condensed refrigerant from a refrigerant reservoir in short pulses at predefined intervals of time into the first vaporizer, wherein the feedback of the condensed refrigerant lowers boiling point of the refrigeration solution in the first vaporizer, and wherein the residual part of the condensed refrigerant in the liquid trap flows by gravity, to said evaporator;

an evaporator for evaporating said residual part of the condensed refrigerant for absorbing heat from said environment wherein said evaporated refrigerant is fed into said absorber;

the absorber for absorbing the evaporated refrigerant by said dilute refrigeration solution in a plurality of absorber columns of the absorber to produce a concentrated refrigeration solution; and said heat exchanger for enabling absorption of heat from the dilute refrigeration solution by said concentrated refrigeration solution for preheating the concentrated refrigeration solution while feeding the concentrated refrigeration solution to the first vaporizer;

whereby the environment is cooled using the low temperature heat source.

8. The cooling apparatus of claim 7, wherein said feedback circuit comprises:

a liquid trap comprising a liquid level switch for preventing the evaporated refrigerant from entering the condenser;

a refrigerant reservoir for storing the condensed refrigerant;

said feedback pump for pumping said stored refrigerant from said refrigerant reservoir to the first vaporizer; and an injector for injecting said pumped condensed refrigerant to the first vaporizer.

9. The cooling apparatus of claim 7, wherein the absorber comprises:

said plurality of absorber columns for enabling said absorption of the evaporated refrigerant by the dilute refrigeration solution;

an absorber pump for pumping the evaporated refrigerant into said absorber columns to a plurality of absorber injectors; and said absorber injectors for injecting said pumped refrigerant into the absorber columns.

10. The cooling apparatus of claim 7, further comprising a microcontroller for controlling flow of the refrigerant, the dilute refrigeration solution, and the concentrated refrigeration solution.

11. The cooling apparatus of claim 7, further comprising a control module for initiating and terminating the cooling.

12. The cooling apparatus of claim 7, wherein the refrigeration solution comprises a refrigerant/absorbent pair comprising the refrigerant and an absorbent, wherein said refrigerant/absorbent pair is selected to be appropriate for absorption refrigeration systems, and wherein the refrigerant/absorbent pair comprises one of many pairs common to compressor systems, wherein the refrigerant comprises one of chlorofluorocarbons, hydrochlorofluorocarbons, hydrofluorocarbons, and a combination thereof, and wherein said absorbent comprises one of oil, a synthetic lubricant, and any liquid miscible with the refrigerant in a liquid phase, and wherein the absorbent is varied based on the refrigerant used.

13. The cooling apparatus of claim 7, wherein said evaporator contains an inert gas for maintaining isobaric pressure in the evaporator.

14. The cooling apparatus of claim 7, further comprising an evaporator fan at the evaporator for cooling air flowing by the evaporator, and a condenser fan at the condenser for cooling the condenser.

15. The cooling apparatus of claim 7, further comprising a condenser valve in proximity to the condenser, a plurality of separator input valves in proximity to the separator, an absorber valve in proximity to the absorber, and an evaporator valve in proximity to the evaporator for use while initiating and terminating the cooling.

* * * * *